US011561044B2

(12) United States Patent
Belokon' et al.

(10) Patent No.: US 11,561,044 B2
(45) Date of Patent: Jan. 24, 2023

(54) APPARATUS FOR DRYING SPENT ION-EXCHANGE RESINS

(71) Applicants: JOINT STOCK COMPANY "ROSENERGOATOM", Moscow (RU); SCIENCE AND INNOVATIONS—NUCLEAR INDUSTRY SCIENTIFIC DEVELOPMENT, PRIVATE ENTERPRISE, Moscow (RU)

(72) Inventors: Denis Evgen'evich Belokon', g. Novouralsk (RU); Aleksandr Valer'Evich Kolchanov, g. Ekaterinburg (RU); Dmitriy Arkhipovich Kukiev, g. Ekaterinburg (RU)

(73) Assignees: SCIENCE AND INNOVATIONS—NUCLEAR INDUSTRY SCIENTIFIC DEVELOPMENT, PRIVATE ENTERPRISE, Moscow (RU); JOINT STOCK COMPANY "ROSENERGOATOM", Moscow (RU)

( * ) Notice: Subject to any disclaimer, the term of this patent is extended or adjusted under 35 U.S.C. 154(b) by 0 days.

(21) Appl. No.: 17/257,279

(22) PCT Filed: Dec. 23, 2019

(86) PCT No.: PCT/RU2019/001053
§ 371 (c)(1),
(2) Date: Dec. 30, 2020

(87) PCT Pub. No.: WO2020/214058
PCT Pub. Date: Oct. 22, 2020

(65) Prior Publication Data

US 2021/0270527 A1 Sep. 2, 2021

(30) Foreign Application Priority Data

Apr. 19, 2019 (RU) ..... RU2019112024

(51) Int. Cl.
*F26B 9/08* (2006.01)
*G21F 9/16* (2006.01)
(Continued)

(52) U.S. Cl.
CPC ..... *F26B 9/085* (2013.01); *F26B 25/04* (2013.01); *G21F 9/16* (2013.01); *G21F 9/28* (2013.01)

(58) Field of Classification Search
CPC .. F26B 9/085; F26B 9/082; F26B 9/08; F26B 25/008; F26B 25/04; G21F 9/16; G21F 9/28; B65D 88/74
See application file for complete search history.

(56) References Cited

U.S. PATENT DOCUMENTS 2,166,351 A * 7/1939 Hagen ..... F26B 17/003 241/293
2,406,682 A * 8/1946 Hayes et al. ..... F26B 5/06 34/76
(Continued)

*Primary Examiner* — Jessica Yuen
(74) *Attorney, Agent, or Firm* — J. Miguel Hernandez; James R. Gourley; Carstens, Allen & Gourley, LLP

(57) ABSTRACT

Apparatus for drying Spent Ion-Exchange Resins (SIER), which can intensify the SIER drying process, reduce power consumption, and accelerate discharge of SIER when the drying process is completed. The apparatus comprises a sealed cylindrical body, and a blow-down choke installed in an upper part of the sealed cylindrical body and a nozzle to feed the spent ion-exchange resins is installed inside the body, and a nozzle to retrieve dried ion-exchange resins is installed in its bottom part and equipped with a locking device. An external heater is provided for the body, and a drive shaft that is installed in alignment inside the body, capable of rotation, and equipped with a stirrer. A lower part
(Continued)

of the drive shaft with lower screw winding is installed in alignment inside the nozzle to retrieve dried ion-exchange resins. The nozzle to retrieve dried ion-exchange resins is equipped with a water draining device.

3 Claims, 1 Drawing Sheet

(51) Int. Cl.
*F26B 25/04* (2006.01)
*G21F 9/28* (2006.01)

(56) References Cited

U.S. PATENT DOCUMENTS 3,495,341 A * 2/1970 Kolb et al. ..... B29B 13/065 34/397
5,966,832 A * 10/1999 Kirkbir ..... F26B 7/00 34/79
8,079,158 B2 * 12/2011 Ekart ..... F26B 7/00 34/325
2014/0366560 A1 * 12/2014 He ..... F25B 21/02 34/88

* cited by examiner

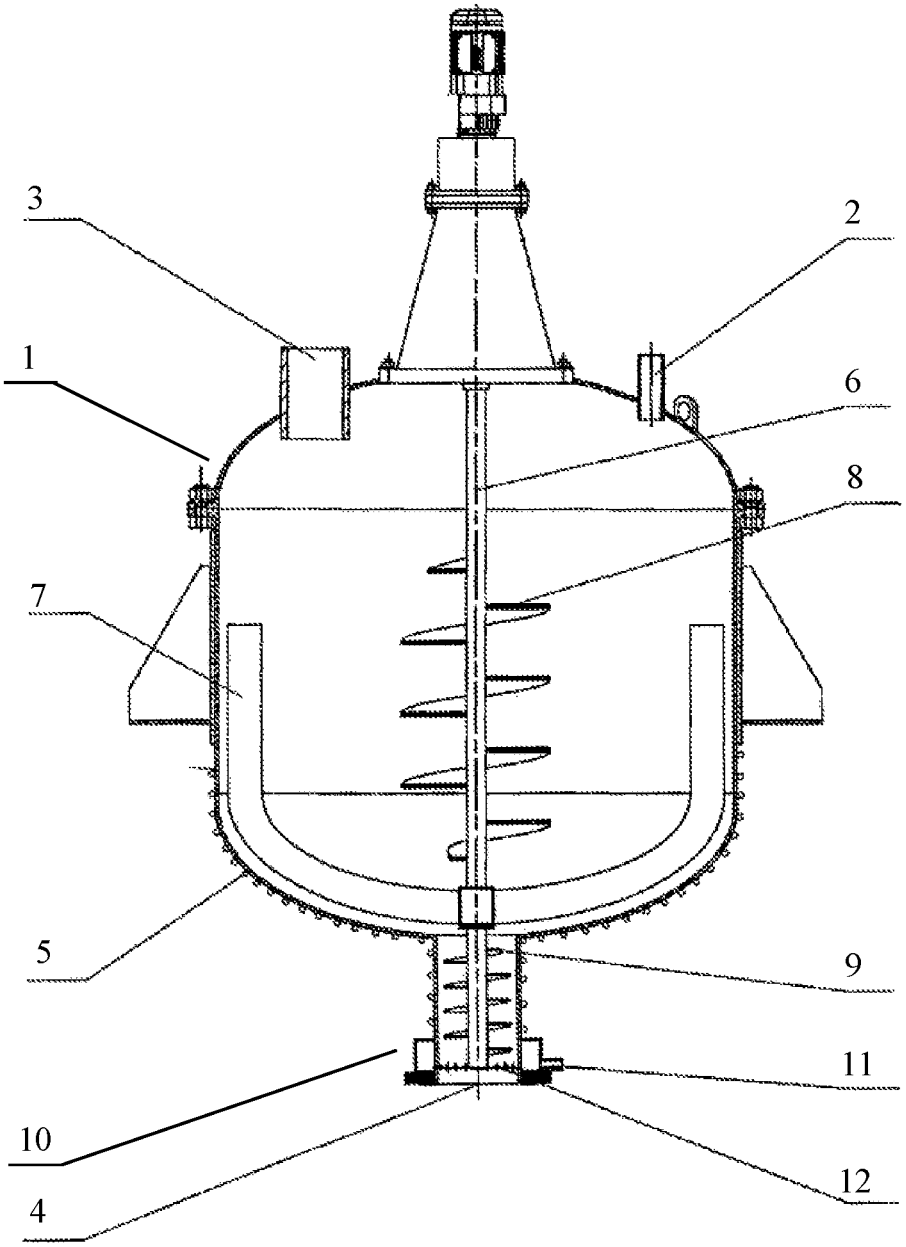
3
2
1
6
8
7
5
9
11
10
12
4

APPARATUS FOR DRYING SPENT ION-EXCHANGE RESINS

CROSS-REFERENCE TO RELATED DISCLOSURE

This application is a U.S. National Stage of International Application No. PCT/RU2019/001053, filed on Dec. 23, 2019, and published as WO 2020/214058 on Oct. 22, 2020, titled "Apparatus for Drying Spent Ion-Exchange Resins," which claims priority to RU 2019112024 filed on Apr. 19, 2019. Each application, publication, and patent listed in this paragraph are hereby incorporated by reference in their entireties.

This invention is referred to atomic energy, in particular, to drying of Spent Ion-Exchange Resins (SIER) and can be used at NPPs or special radioactive wastes processing plants.

Ion-exchange resins are widely used at NPPs to ensure water chemistry in primary and secondary circuits, fine filtering of evaporation plant condensate and in other auxiliary water systems, as well as during NPP decommissioning. Considerable volume of SIER is accumulated during operation, so these resins are required to be processed for further storage. Long-term and safe storage of SIER is possible in the sealed protective casks, where SIER's residual moisture content is not more than 5% by weight. This limit is stipulated by possible radiolysis of residual moisture during storage/disposal of a sealed protective cask.

A plant for thermal processing of radioactive ion-exchange resins is well-known now (Patent of the RF for useful model No. 121396), it contains thermal reactor that is equipped with loading and discharging units and the heater. This plant also contains water vapors condenser, connected to thermal reactor by main pipe, condensate receiver, connected to water vapors condenser via main pipe, as well as vacuum pump which inlet is connected to condensate receiver and its outlet is connected to air exhaust main pipe.

Low energy efficiency of the process is one of the disadvantages related to the above described SIER drying method.

The spent ion-exchange resins drying plant (Patent of the RF No 161811), comprising the cylindrical body, in upper part of which the vapor and gas exhaust choke is installed and the nozzle to feed spent ion-exchange resins inside the body and the nozzle to retrieve dried ion-exchange resins, equipped with the locking device is installed in bottom part of the body is the most similar technical solution that is taken as a prototype. The cylindrical body is also equipped with the external heater for the body, that is installed in alignment inside the body and that can be rotated by drive shaft, equipped with the stirrer.

Disadvantage of the closest analogue is referred to low specific capacity of the process, as well as too long period of drying and it's resulted in increased power consumption.

Object of the claimed invention is to intensify SIER drying process and to reduce power consumption, and to accelerate discharge of SIER when drying process is completed.

Technical result that can be achieved by the claimed invention is to reduce period and power consumption for SIER drying process as well as to accelerate discharge of SIER when drying process is completed.

The indicated technical result can be achieved due to installation of the blow-down choke and the nozzle to feed the spent ion-exchange resins inside the body in upper part of the sealed cylindrical body of the spent ion-exchange resins drying plant, as well as the nozzle to retrieve dried ion-exchange resins is installed in its bottom part, and this nozzle is equipped with the locking device, the external heater for the body and the drive shaft that is installed in alignment inside the body including possibility of its rotation, and it's equipped with the stirrer, it's proposed to make the stirrer as an anchor mixer that is rigidly fixed on the drive shaft, the mixer blades shall follow the shape of internal surface of bottom and side part of the body and located on the drive shaft upper and lower the place where the anchor mixer is fixed including upper and lower one-way screw windings, by this lower part of the drive shaft with lower screw winding shall be installed in alignment inside the nozzle to retrieve dried ion-exchange resins and the nozzle to retrieve dried ion-exchange resins shall be equipped with the water draining device.

Height of blades of the anchor mixer and the upper screw winding located on the drive shaft mainly shall be more than the height of heating area of the external heater for the body.

The water draining device can be made in the form of cylindrical water tank that is coaxially installed at lower edge of the nozzle and aimed to retrieve drained ion-exchange resins, including special choke to drain water, and on perimeter of lower cylindrical part of the nozzle to retrieve drained ion-exchange resins, the holes are made to connect inner cavity of the nozzle with the water tank cavity.

BRIEF DESCRIPTION OF THE DRAWINGS

FIG. 1 illustrates an example of a scheme of the spent ion-exchange resins drying plant in one of the variants.

DETAILED DESCRIPTION OF THE DRAWINGS

The spent ion-exchange resins drying plant shall contain the sealed cylindrical body 1, in upper part of which the blow-off choke 2 is installed and the nozzle 3 to feed spent ion-exchange resins inside the body 1 is installed, as well as in its bottom part, the nozzle 4 is installed to retrieve spent ion-exchange resins and it is equipped with the locking device (it's not shown on the drawing) and the water draining device. The sealed cylindrical body 1 is equipped by the external heater 5.

The drive shaft 6 that is equipped by a stirrer is installed in alignment in the sealed cylindrical body 1 with a possibility of its rotation. The stirrer as an anchor mixer 7 that is rigidly fixed on the drive shaft 6, the mixer blades shall follow the shape of internal surface of bottom and side part of the sealed cylindrical body 1 and located on the drive shaft 6 upper and lower the place where the anchor mixer 7 is fixed including upper 8 and lower 9 one-way screw windings. Lower part of the drive shaft 6 with the lower screw winding 9 is place in alignment inside the nozzle 4 to retrieve dried ion-exchange resins.

Model of the spent ion-exchange resins drying plant, in which blades of the anchor mixer 7 and the upper screw winding 9 located on the drive shaft 6 are made at the height that is more than heating area of the external heater 5, as well as the water draining device is made as cylindrical water tank 10 installed outside coaxially on lower end of the nozzle 4 to retrieve dried ion-exchange resins, including the choke 11 to drain water, and on perimeter of the lower cylindrical part of the nozzle 4 to retrieve drained ion-exchange resins, the holes 12 shall be made to connect inner cavity of the nozzle 4 with the water tank cavity 10 is shown on the drawing.

The spent ion-exchange resins drying plant is operated in the following way. The nozzle 4 to retrieve dried ion-exchange resins shall be closed by the locking device. De-watered SIER with mass ratio "Solid phase:Liquid" (S:L) from 1:1 to 1:3 can be partly loaded into the sealed cylindrical body 1 through the nozzle 1 to feed spent ion-exchange resins. Excessive liquid shall be drained by gravity from the sealed cylindrical body 1 through the holes 12, made on lower cylindrical part of the nozzle 4 to retrieve dried ion-exchange resins, into the cylindrical water tank 10 and then it shall be drained via the choke 11 into the radioactive drain system. When the sealed cylindrical body 1 is filled, feed of SIER shall be stopped and vacuum shall be created inside the sealed cylindrical body 1 through the blow-off choke 2. The external heater (electric or steam) 5 shall be activated and rotation of the drive shaft 6 where the anchor mixer 7 and one-way upper 8 and lower 9 screw windings are rigidly installed, shall be initiated. By this one-way upper screw winding 8 and lower screw winding 9 along with the drive shaft 6 are rotated in such direction in which SIER are pushed up from the nozzle 4 to retrieve dried ion-exchange resins and lower part of the sealed cylindrical body 1, shall initiate movement inside the body 1 and additionally are intensively stirred by the anchor mixer blades. Temperature of SIER by means of the external heater 5 during drying process shall be maintained not more than 90° C. aimed to avoid thermal decomposition of SIER. When SIER drying process is completed, the external heater 5 shall be deactivated and rotation of the drive shaft 6 shall be stopped. SIER shall be cooled up to the temperature, not exceeding 50° C. before discharge from the plant.

Sealed protective cask (container) shall be installed under the nozzle 4 to retrieve dried ion-exchange resins to discharge the dried SIER. The locking device installed in lower part of the nozzle 4 to retrieve dried ion-exchange resins shall be opened and the dried SIER shall be discharged into the cask. Reverse rotation of the drive shaft 6 shall be activated to improve and accelerate the process to discharge the dried SIER. By this one-way upper screw winding 8 and lower screw winding 9 along with the drive shaft 6 are rotated in such direction in which SIER are pushed down from the sealed cylindrical body 1 and the nozzle 4 to retrieve dried ion-exchange resins and they shall be discharged into the sealed protective cask.

The claimed invention shall ensure reduction of power consumption, the process stimulation and considerable reduction of drying period due to effective mixing of SIER during drying process, as well as acceleration of SIER discharge when drying is completed.

What is claimed is:

1. An apparatus for drying spent ion-exchange resins comprising a sealed cylindrical body, in upper part of which a blow-off choke is installed and a first nozzle to feed spent ion-exchange resins inside the sealed cylindrical body is installed, in a bottom part of the sealed cylindrical body, a second nozzle is installed to retrieve spent ion-exchange resins, the bottom part of the sealed cylindrical body further includes an external heater and a drive shaft that is installed in alignment inside the sealed cylindrical body for rotation, the drive shaft is equipped with an anchor mixer that is rigidly fixed on the drive shaft, the anchor mixer includes mixer blades having a shape conforming to an internal service of the bottom part of the sealed cylindrical body and a side part of the sealed cylindrical body, wherein an upper part of the drive shaft comprises one-way screw windings and a lower part of the drive shaft comprises one-way screw windings, the lower part of the drive shaft with one-way screw windings are aligned inside the second nozzle retrieve the dried ion-exchange resins, and wherein the second nozzle forms part of a water draining device.

2. The apparatus for drying spent ion-exchange resins according to claim 1, wherein the mixer blades of the anchor mixer and the upper one-way screw windings extend above a heating area defined by the external heater installed on the bottom part of the sealed cylindrical body.

3. The apparatus for drying spent ion-exchange resins according to claim 1, wherein the water draining device is made in the form of a cylindrical water tank that is coaxially installed at a lower end of the second nozzle and configured to retrieve the spent ion-exchange resins, including a special choke to drain water, and on a perimeter of the lower cylindrical part of the second nozzle to retrieve drained ion-exchange resins, holes are made to connect an inner cavity of the second nozzle with a cavity of the cylindrical water tank.

* * * * *